United States Patent [19]

Shinotsuka

[11] Patent Number: 4,979,728

[45] Date of Patent: Dec. 25, 1990

[54] APPARATUS FOR STORING AND SUPPLYING SHEET LIKE MATERIALS

[75] Inventor: Hiromi Shinotsuka, Sayama, Japan

[73] Assignee: AB Tetra Pak, Lund, Sweden

[21] Appl. No.: 406,762

[22] Filed: Sep. 13, 1989

[30] Foreign Application Priority Data

Sep. 14, 1988 [JP] Japan ..... 63-231268

[51] Int. Cl.[5] ..... B65H 3/08

[52] U.S. Cl. ..... 271/99; 271/35; 271/165; 414/795.8; 414/797.8; 414/907

[58] Field of Search ..... 414/795.8, 797.8, 907; 271/102, 35, 165, 166

[56] References Cited

U.S. PATENT DOCUMENTS

| | | | |
|---|---|---|---|
| 3,947,017 | 3/1976 | Seragnoli | 271/99 |
| 4,081,945 | 4/1978 | Calvert | 271/99 X |
| 4,364,549 | 12/1982 | Komossa | 271/165 X |

*Primary Examiner*—Richard A. Schacher
*Attorney, Agent, or Firm*—Koda and Androlia

[57] ABSTRACT

An apparatus for storing and supplying folded container blanks where the blanks are temporarily stored in a pile and are then removed one at a time for the next processing step. The apparatus includes a guide member for vertically guiding the blanks and a vertical mover having confronting support members which project into the guide member at the upper loading position where the blanks are loaded onto the support members of vertical mover. The blanks thus loaded on the vertical mover are downwardly transferred to a lower position where the support members release the blanks. The apparatus further includes a pile setter located beneath the vertical mover which receives the blanks as they are released from the vertical mover so that the blanks are removed from the bottom of the vertical mover and a pressing assembly which is provided beneath the vertical mover and above the setting members which presses the blanks down with their own weight so that at least one blank is pressed against the setting members. The pressing assembly has claws which project into the guide member when the number of blanks on the setting members decrease to a number less than a predetermined amount and retract when pressed backward by the downwardly moving vertical mover. The apparatus also has a pull-out unit having a suction port which pulls the blanks out of the pile setter one at a time so as to transfer each blank to the next processing step.

10 Claims, 8 Drawing Sheets

FIG. 13(a)
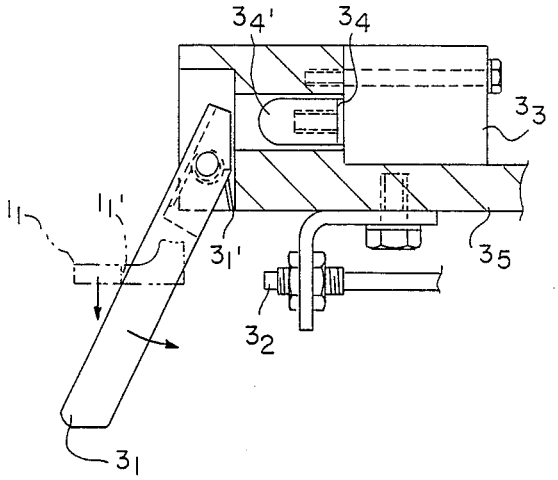
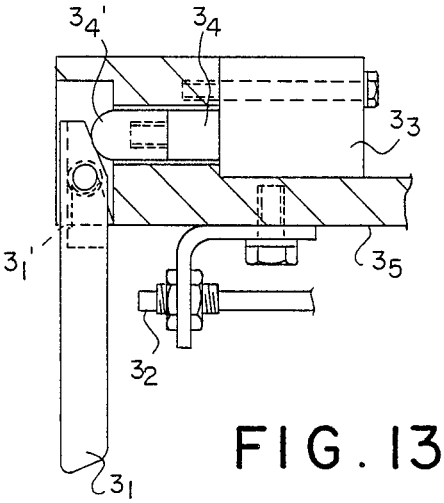
FIG. 13(b)

APPARATUS FOR STORING AND SUPPLYING SHEET LIKE MATERIALS

BACKGROUND OF THE INVENTION

1. Field of the Invention

The present invention relates to an apparatus for storing and supplying sheet-like materials in which while a plurality of uniform sheet materials e.g. flattened tubular blanks, are stored in a pile in a magazine, they are delivered one by one to an apparatus in the following step of procedure such as a buid-up device for forming such blanks into a cross-sectionally square configuration, and more particularly, to an apparatus in which the replacement of sheet-like materials in a magazine, the re-supply of sheet-like materials to the magazine during operation, and the removal of sheet-like materials from the magazine after operation can be made.

2. Prior Art

There have been produced various known paper-made containers for respective use, such as disposable packaging containers for beverage, e.g. milk. Such a packaging container is preliminarily formed into a tubular packaging container blank having folding line thereon and sealed lengthwisely thereof which can thus be turned readily to a finished form of packaging container without use of any extra procedure such as cutting, and more specifically on an automatic packaging machine, is closed in the bottom while its top end remains open and then, at a filling section of the automatic packaging machine, filled with liquid food, e.g. milk, before sealed out. The tubular packaging container blank is supplied in a flattened sheet form for ease of storage, transportation, and other handling. The tubular packaging container blank of sheet form is needed to shift from the flattened tubular sheet form to the cross-sectionally square finished form so as to become a container with the bottom closed and the top end kept open for filling with liquid food on the automatic packaging machine. In a prior art, such as depicted in Japanese patent provisional publication No. SH057-163615 (1982), while a plurality of such blanks are loaded into a magazine installed in a build-up device, they are shaped one by one by the build-up device. Also as disclosed in Japanese patent Provisional publication No. SH059-209512 (1984), such flattened tubular blanks while loaded into a magazine is delivered one by one by a conveyor and shaped by a build-up device.

With respect to a magazine in such a known machine, the loading and replacement of sheet-like packaging container blanks into the magazine requires labor work. Particularly, as there is needed the re-supply of blanks during continuous operation or the shift of blank to another form due to a change in procedure of operation, manual handling should be carried out and thus, production efficiency is much affected.

SUMMARY OF THE INVENTION

The present invention is directed, in view of the above aspect, towards an apparatus for storing and supplying sheet-like materials such as packaging container blanks in which its magazine is kept filled with such blanks during operation by automatically loading the blanks thereto in response to the consumption of blanks in processing so that the blanks can be delivered one by one without interruption for the next step of procedure and also, both the removal of blanks after operation from the magazine and the replacement of blanks in the magazine due to a change of operation can be accomplished with ease.

To achieve the object described above, the present invention is directed towards an apparatus comprising: at least confronting guide members for guiding the sheet-like materials in vertical directions; collecting and moving means for transferring sheet-like materials, arranged movable vertically with confronting support members projectable inwardly from the side of the guide members from an upper loading position where the plurality of sheet-like materials can be loaded onto the support members for downward transfer to a lower position where the support members can retract to release the supporting of the sheet-like materials for further downward transfer: pile setting means provided beneath the collecting and moving means and arranged for receiving the sheet-like materials released from the collecting and moving means with a pair of confronting setting members, or the sheet-like materials being placed onto the existing pile of sheet-like materials which are previously transferred from the collecting and moving means to the setting members, and for removing the sheet-like materials from the bottom thereof; pressing-down means for pressing the sheet-like materials downward with its own weight, provided beneath the collecting and moving means and above the setting members for downward movement cooperatively with the collecting and moving means and pressing at least one sheet-like material to the setting surfaces of the setting members of the setting means, and having a pair of confronting press-down claws projectable to a downward transfer passage of sheet-like materials when a detecting means generates a signal upon detecting that the number of the sheet-like materials on the setting members decreases to less than a predetermined number while retracting as being pressed by the support members during the downward movement of the collecting and moving means; and pulling infeed means mounted beneath the setting means and having vertically movable suction sections for pulling the sheet-like materials one by one outward from the setting means for transferring to the next step of procedure. Thus, the the sheet-like materials loaded into the collecting and moving means can continuously be transferred downward to the setting means by transferring the sheet-like materials. which are loaded onto the support members of the collecting and moving means actuated for projection by a loading signal, from the collecting and moving means to the upper surface of the pile of existing sheet-like materials placed on the confronting setting members which are pressed downward by the confronting press-down claws of the pressing-down means actuated for projection by a signal derived from the detecting means when the uppermost surface of the existing sheet-like materials passes a predetermined point in the upper of the setting means, and removed one by one by the pulling of the pulling infeed means for transfer to the next step of procedure. Additionally, the remaining sheet-like materials in the setting means can be returned by lifting upward back to the loading position for removal.

In addition, the collecting and moving means pile setting means, and pressing-down means are mounted vertically and arranged tilting to the loading side of the pile of sheet-like materials and also, incorporated with the guide members arranged tilting to the loading side for guiding the pile of sheet-like materials movable in vertical directions at least in the left and right sides and loading side of its lengthwise direction. The guide members at one side are arranged in a line while the guide members at the other side facing the guide members on the opposite side are separated into upper and lower portions. The guide member for restriction in the loading side is also separated into upper and lower portions. The lower portions of the guide members separated at a position jut below the loading position of the vertically movable support members of the collecting and moving means are arranged in fixed relationship to the guide members on the opposite side while the upper portions of the same are integrally arranged for movement away from said guide members in the opposite side with the guide member retracting from the passage of sheet-like materials due to a signal from the detecting means. This arrangement is effective when a device in the next step of procedure is arranged tilting.

Furthermore, the press-down claw, which is pivotably mounted and urged inwardly, when retracting as being pressed by the support member during the downward movement, is pressed in the upper back outwardly by the inner side of a C-shaped portion of the support member projecting into the vertically opening passage of sheet-like materials and thus kept withdrawn from the passage by a claw stopper actuated by a signal derived from proximity detecting means provided in a position in the back of the press-down claw.

Additionally, there is detecting means provided above the loading position of the support member of the collecting and moving means for sending a preparation signal for loading of the sheet-like materials on the support members of the collecting and moving means onto the uppermost surface of the existing sheet-like materials on the setting members of the pile setting means upon detecting that the number of the existing sheet-like materials on the setting members decreases to less than a predetermined number.

Moreover, the confronting setting members of the pile setting means are mounted to the lowermost ends of the guide members, which guide the sheet-like materials in vertical directions, so as to extend inwardly to an extent while each of the support members is arranged between the lengthwisely spaced setting members for vertical movement.

According to the apparatus described above, for the operation of storing a pack of desired uniform sheet-like materials in the apparatus after transferring them from a storage by transferring and loading means such as a picking robot and removing them obe by one for transfer to the next step of procedure, the plurality of sheet-like materials in a pile are loaded at the loading position where the sheet-like material collecting and moving means is at the uppermost position onto the confronting support members of the collecting and moving means which are actuated for projection from the sides of confronting guide members arranged to guide the sheet-like materials in vertical directions, lifted downward in the collecting and moving means, and transferred from the support members of the collecting and moving means to the confronting setting members of the setting means located in the lower region of the appratus. Then, the paired support members retract from the vertical passage of sheet-like materials and move upward to the upper original position. (During the downward and upward movement, the press-down claws are also actuated comovably for downard and upward movement.) At the time, the pulling infeed means located in the lowermost region of the apparatus is also actuated for removing the sheet-like materials one by one downward from the downwardly situated setting members by pulling with its vertically moving suction sections and placing them onto a transferring conveyor running towards the next step of procesure. As the operation proceeds, the sheet-like materials are removed from the apparatus and the pile of sheet-like materials on the setting members decreases gradually in height. If resupply of sheet-like materials is needed for continuous operations, when the detecting means detects that the uppermost surface of the pile of sheet-like materials on the setting members is below the predetermined position, the support members of the collecting and moving means are actuated for projection into the vertical passage of sheet-like materials for the purpose of re-loading while the press-down claws of the pressing-down means project and move downward to press against the uppermost surface of the sheet-like materials. Then, the support members loaded with another pile of sheet-like materials move downward and retract the inwardly projecting press-down claws for transfer of the supplied sheet-like materials onto the existing sheet-like materials on the setting members. Accordingly, when the sheet-like materials loaded onto the setting members decrease in number as the operation proceeds, a supply of materials is automatically carried out by repeating this process and thus, the continuous loadings by labor power can be eliminated. Additionally, before the stop of loading of sheet-like materials at the end of operation, the press-down claws of the pressing-down means presses on the uppermost surface of the remaining sheet-like materials in less number using their own weight till all the materials are removed. This ensures the transfer of sheet-like materials from the setting means to the conveyor for the next step of procedure.

Furthermore, if some of the sheet-like materials remain on the setting members at the end of operation, the collecting and moving means is actuated for downward movement to receive the remaining sheet-like materials on its support members and then, move upward back to the loading position for removal and returning of the same to the external storage. This also allows the sheet-like materials stored in the apparatus to be replacable with ease when a change for the operation is needed.

The collecting and moving means, pile setting means, and pressing-down means are arranged tilting in a degree to the loading side while the guide members at one side for guiding the sheet-like materials in vertical direction and the guide member for restriction in the loading side are separated into their respective upper and lower portions at about the uppermost position of the support members for loading of sheet-like materials. Particularly, one of the upper portions of the guide members can retract from the passage of loading. Thus, even if a device in the next step of procedure is tilted to the loading side, the supply of sheet-like materials to the next step can be made smoothly. Also, the loading of sheet-like materials into the collecting and moving means in the tilting apparatus can easily be carried out without interruption of the guide members in the loading side.

The press-down claw is retractable into the opening of the C-shaped portion of the support member and the retracting action is detected by the proximity detecting means which in turn sends a signal for actuating the claw stopper, so that it can securely be kept retracted in position.

The detecting means produces a preparation signal for loading of sheet-like materials onto the supporting members upon detecting that the number of the existing sheet-like materials on the setting members reduces to less than a predetermined number. Then, the signal can actuate the sheet-like material transferring and loading means such as a picking robot for constant loading operation with no loss of time.

The confronting setting means are mounted in the lowermost end of the guide members so as to extend inwardly to an extent while the support members are vertically movable between the setting members. Thus, the sheet-like materials can easily be removed by pulling from the below and also, transferred from the support members to the setting members smoothly.

BRIEF DESCRIPTION OF THE DRAWINGS

The drawings show one embodiment of the present invention, in which:

FIG. 13(*a*) is a partially longitudinally cross sectional front view of a mounting drive section of the press-down claw showing the press-down claw projected moves backward about a pivot as being pressed by a support member;

FIG. 13(*b*) is a partially longitudinally cross sectional view of the same showing the press-down claw retracted remains in a specified position;

DETAILED DESCRIPTION OF THE INVENTION

An apparatus according to the present invention will be described with relation to sheet-like materials disclosed in the form of flattened tubular packaging container blanks for use in packaging liquid food, e.g. milk.

Figure 14:
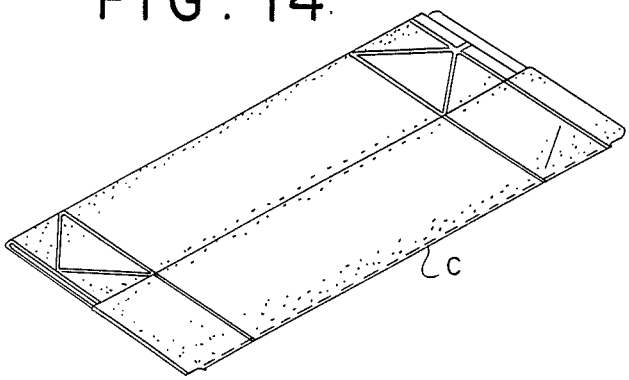
FIG. 14 is a perspective view of the flattened sheet-like packaging container blank.
Figure 15:
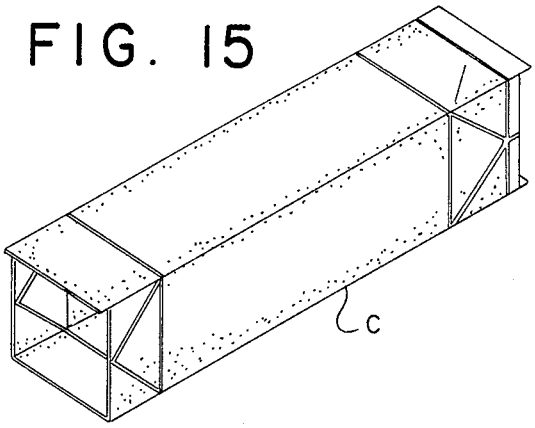
FIG. 15 is a perspective view of the packaging container blank formed into a cross-sectionally square shape.

Such a packaging container blank is formed from a packaging material having a layer of thermoplastic plastic, e.g. polyethylene, closely fitted onto either side of a center paper sheet thereof. The packaging container blank is cut into a determined shape and provided with folding lines thereon for ease of folding and forming operation and then, formed into a flattened tubular packaging container blanks (see FIG. 14) by sealing the lengthwisely extending joint portions thereof. The flattened packaging container blanks C are packaged in a specified number (e.g. 250) as a piled bale for transportation. The bale of blanks is carried to the side of a packaging machine for loading and unpacked for storage in a pre-supply magazine of the machine. Each of the packaging container blanks is shaped in a cross-sectionally square form (see FIG. 15) before shifting into a finished packaging container on the packaging machine. The packaging container blank C in a square shape is infed to the packaging machine where it is filled with liquid contents and turned to a sealed packaging container.

The apparatus according to the present invention is equipped with a magazine for storing and supplying packaging container blanks and supplied with a desired amount of the blanks by a picking robot, means for transferring blanks from a plurality of pre-supply magazine, for the purpose of continuous and automatic supply of the blanks to a blank build-up device in the packaging machine in response to the continuous action of the packaging machine and also, of replacement of the blanks in response to a particular job due to a change in filling of liquid on the packaging machine.

Figure 1:
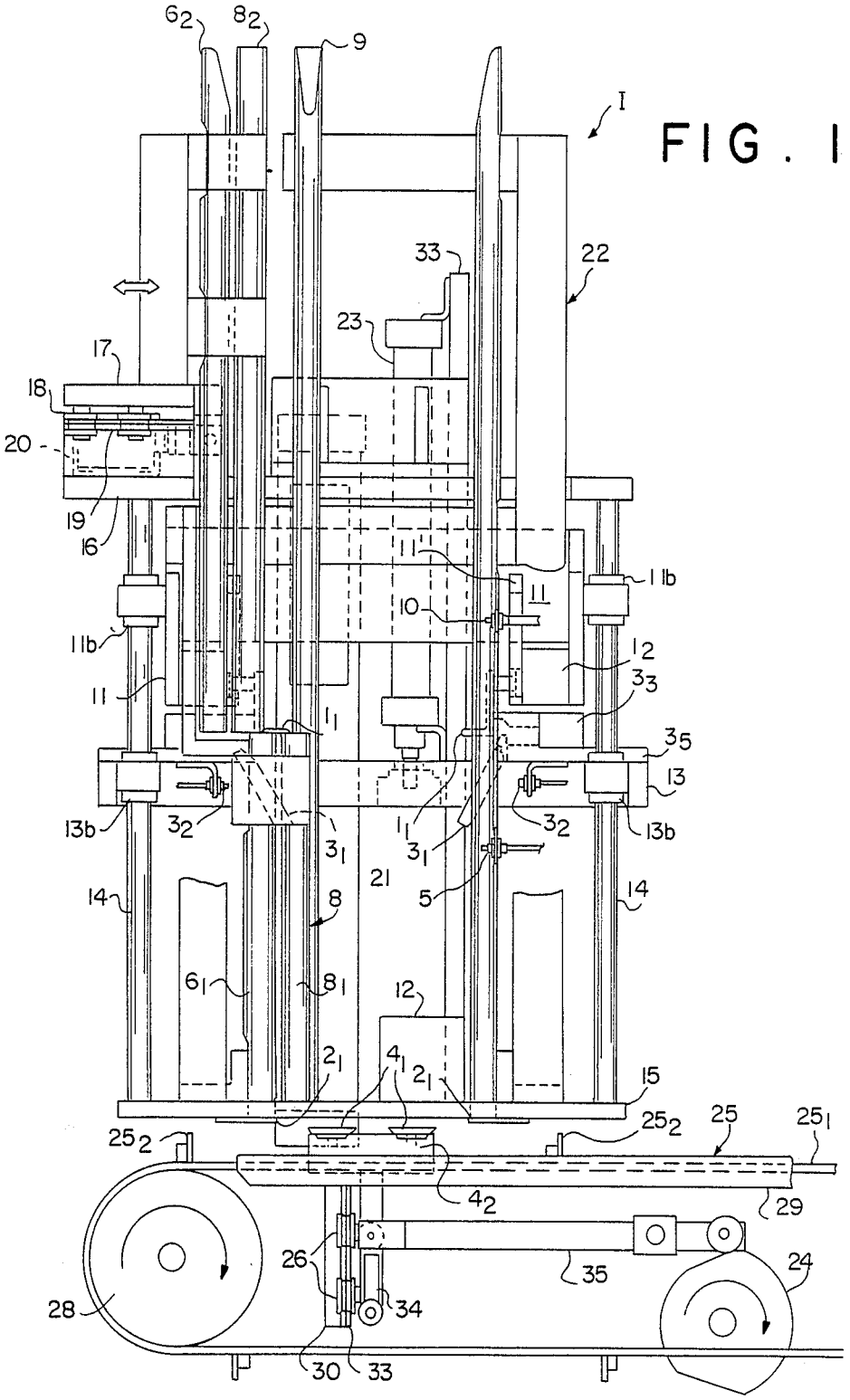
FIG. 1 is a front view showing an apparatus associated with a conveyor according to the present invention which is in a vertical position although, in practical use, arranged tilting 18° from the upright position.
Figure 2:
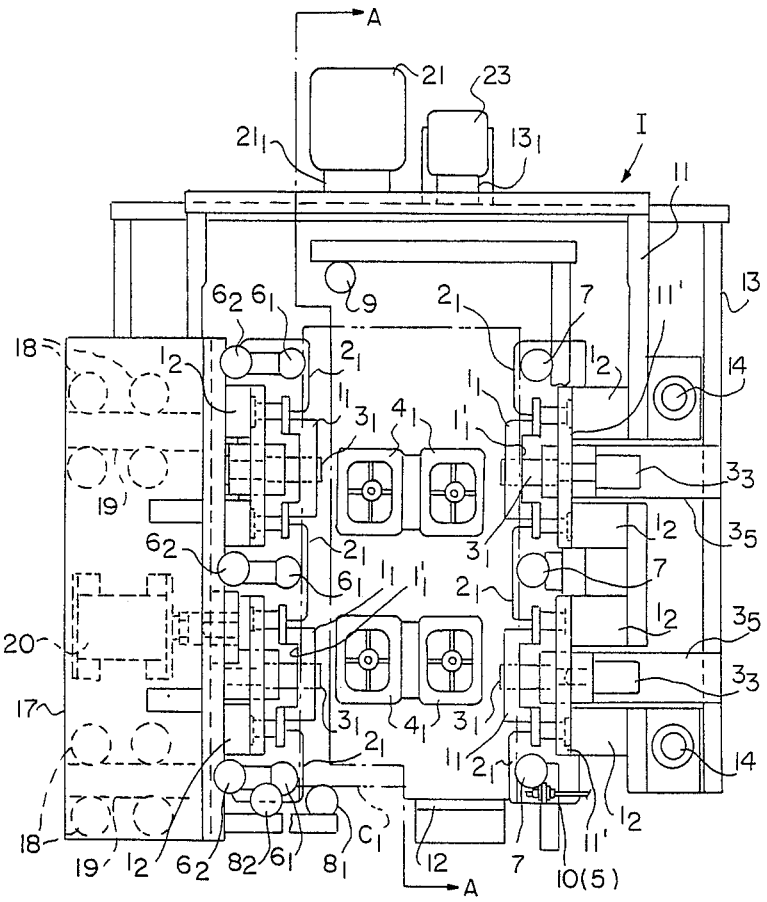
FIG. 2 is a plan view of the primary part of FIG. 2.

FIG. 1 is a front view of the apparatus provided with the storage and supply magazine for packaging container blanks while FIG. 2 is a plan view showing a primary part of the same. The apparatus is shown in a vertical position, which is virtually arranged tilting 18° from the vertical position for loading a blank onto a mandrel of a filling machine.

Figure 3B:
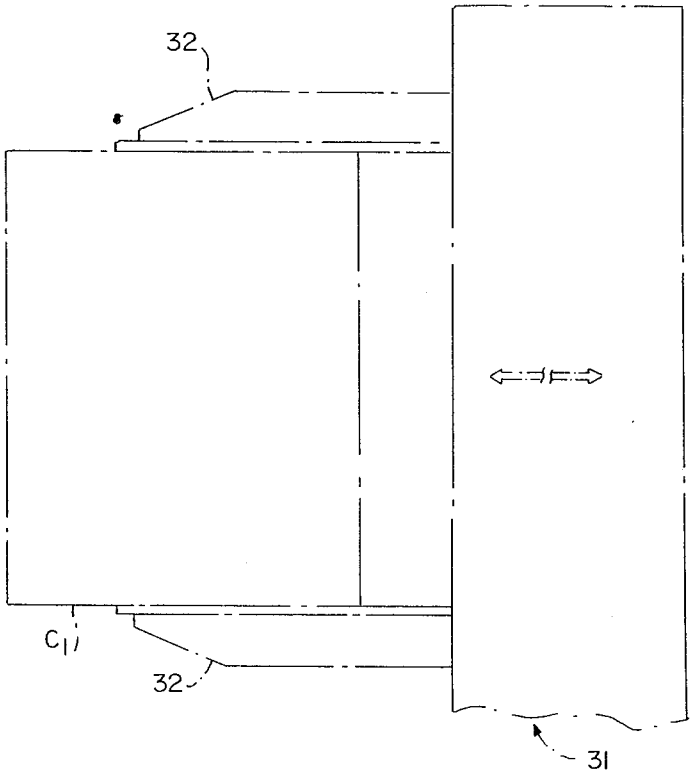
FIG. 3 is a longitudinally cross sectional side view taken along the line A—A of FIG. 2, showing the relation with a picking robot.
Figure 3A:
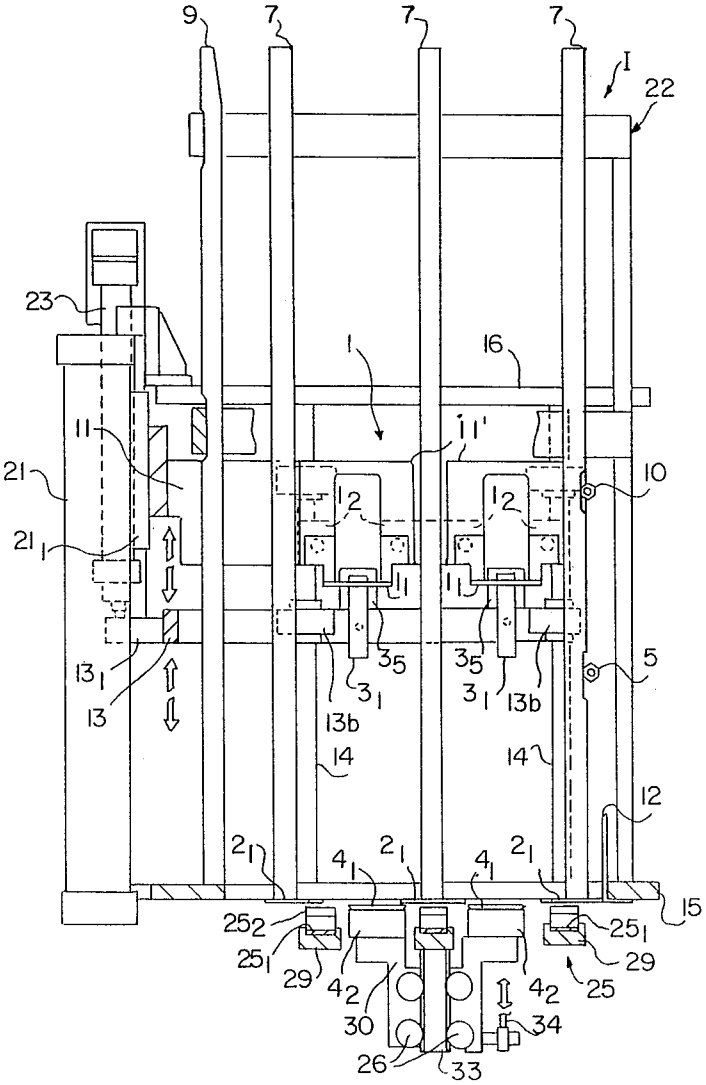

A specified number (e.g. 250) of packaging container blanks C in a bale C1 held by a pair of upper and lower folks 32, 32 of a picking robot 31 (see FIG. 3) are transferred from a pre-supply magazine not shown to the front of the magazine I (see FIG. 3) in the apparatus and then, loaded into the magazine I remaining open. The magazine I has a plurality of guide bars 6, 7, 8, and 9 for guiding the sheet-like packaging container blanks C in the center of the magazine I through a vertically opening passage to a base plate 15. Three of the long guide bars 7 are mounted at specified intervals on the right of the magazine I for guiding the sheet-like packaging container blanks C lengthwisely. The guide bars 6 are mounted on the opposite further end at the loading side for restricting the position of a sheet-like packaging container blank having a maximum length so as to correspond to any length of a packaging container blank having a distinct capacity. The guide bar 8 for restricting the sheet-like packaging container C in widthwise directions at right angles to the lengthwise directions is separated at the loading lowermost end into an upper section and a lower section. Three of the lower guide bars $6_1$ are mounted at equal intervals on the left of the loading direction. The guide bar 8 for restriction on the left of the width directions is also separated at the loading lowermost end into an upper portion and a lower portion. On the loading side, the lower guide bar $8_1$ is mounted on the near left of the base plate 15. There is a guide plate 12 mounted to a member, not shown, which is mounted in fixed relationship to the base member 15 for restricting a right front projecting portion of the sheet-like packaging container blank so that the front end of the blank can moves upto just below the bottom of the base plate 15 (see FIG. 3). The guide bars $6_1$, 7, and $8_1$ on the base plate 15 are secured to the base plate 15 by a frame member 22.

There is an upper shelf plate 16 mounted to the upper portions of four guide rods 14 at a position spaced above from the base plate 15. The four guide rods 14 are mounted in position on the base plate 15, two on the left and other two on the right, for guiding four guide bushings **11*b* mounted to a frame 11 of a collecting and moving means described later, for sheet-like packaging container blanks C and also, four other guide bushings 13*b* mounted to a frame 13 of a pressing-down means 3. On the upper shelf plate 16 having an opening therein extending from the front to the center, there is mounted a opening/closing guide bar support 17 for movement to left and to right, to the right of which four left upper guide bars separated at the loading lowermost end for opening and closing motion during loading, or three of the lower guide bars $6_2$ for restricting the left of a blank lengthwisely and the lower guide bar $8_2$ on the loading side are unit mounted fixedly and supportedly. More specifically, the support plate 17 has four grooved guide rollers 18 mounted by axes respectively on either of the near and far sides of the bottom thereof and is movable to left and right along guide plates 19, each of which having tapered edges in both the sides and being mounted to a support at a height over the upper shelf plate 16, so that the upper guide bar $8_2$ can move for opening and closing the loading passage of sheet-like blanks. The support plate 17 is connected to one end of the piston of a auto-switch equipped cylinder 20 for leftward and rightward movement and when it advances to the right, the guide bars $6_2$, $6_2$, $6_2$, and $8_2$ are positioned coaxially of the guide bars $6_1$, $6_1$, $6_1$, and $8_1$ mounted on the left center of the base plate respectively. On the left and right of the frame 11 in the collecting and moving means 1, there are four support members $1_1$ for lifting the pile C1 of sheet-like packaging container blanks C upward and downward loaded thereonto and then, transferring the sheet-like blanks downward, a pair of which being mounted on either side and extends inwardly. As shown in the cross sectional view of the magazine I, each the support member $1_1$ are fixedly connected in both ends to the piston ends of a pair of left and right cylinders $1_2$, $1_2$ for forward and backward movements within a length of distance (e.g. of 10 mm). Thus along the vertical passage of sheet-like packaging blanks defined by the guide bars 6, 7, 8, and 9, the pile C1 of sheet-like packaging container blanks can be supported by the upper sides of the support members $1_1$ when projected and will lower due to its own weight when they are withdrawn. Each the support member $1_1$ is formed into a C-shaped configuration designated in a plan view. There is a press-down claw $3_1$ extending across the C-shaped support member $1_1$ and mounted at inner end of the blank passage on a support block $3_5$ which has a cylinder $3_3$ mounted on the uppermost end thereof for restricting the projecting motion of the press-down claw $3_1$ into the blank passage. The press-down claw $3_1$ is urged by a spring $3_1$, so that its lowermost end can extend to an extent towards the vertically extending passage of sheet-like blanks. Accordingly, when the press-down claw $3_1$ retracts from the passage upon being pressed with the inner side $1_1$, of the C-shaped support member $1_1$ of the collecting and moving means 1 which travels downward, the cylinder $3_3$ is actuated by a signal from a proximity switch $3_2$ which is mounted on the lower of the support block $3_5$ so as to locate on the back of the claw $3_1$. Thus, the piston $3_4$ projects with its front end or a claw stopper $3_4$, pressing against the upper end of a support axle of the claw $3_1$ to move the front end of the claw $3_1$ to its retracting position. The press-down claw $3_1$ is actuated to project and press down against the uppermost face of the pile of sheet-like container blanks C1 when the height of the pile C1 located in a setting section $2_1$ provided in the lower of pile setting means 2 described later, is less than the determined setting. The vertically movable frame 11 incorporated with the support members $1_1$ of the collecting and moving means 1 is arranged in a planely large C-shaped form having an opening in the loading side and also, connected in the rear center to the front end of a movable block $21_1$ of a lifting cylinder 21 which is in turn mounted in the rear end to the rear ends of the base plate 15 and upper shelf plate 16, so that it can travel upward and downward with its guide bushings 11*b* moving along the guide rods 14. Each of the support block $3_5$ to which left and right press-down claws $3_1$ are pivotably mounted on both the sides of the vertically opening passage of sheel-like packaging container blanks, is mounted in place to the upper of a planely large C-shaped frame 13. The frame 13 is connected in the rear center to the piston end, or lower end of a pressing-down cylinder 23 mounted at both ends to a support plate 33 on the base plate 15 by a connecting block $13_1$, so as to travel upward and downward with its guide blocks 13*b* moving along the guide rods 14**.

The left and right guide bars $6_1$ and 7, which are fixedly mounted on the base plate 15, three bars on either side, to constitute a setting means 2 for positioning the lowered sheet-like blanks, are incorporated at lowermost end with setting members $2_1$, the top of which corresponding to the bottom of the base plate 15, so that the setting members $2_1$ can support the pile of sheet-like blanks lifted down thereonto for downward unloading and extend to an extent (e.g. of 2.5 mm) towards the passage of sheet-like blanks.

Above the upper face of the setting member $2_1$, there is a photo switch 5 mounted at the front of the near-side right guide bar 7. The photo switch 5 is adapted to send a signal, upon detecting that the pile of sheet-like container blanks on the setting member $2_1$ is lifted downward with its upper side lowering below the setting position during downward movement, for moving the press-down claws $3_1$ of the pressing-down means 3 from its position a bit higher than the setting position towards the inside of the passage of sheet-like blanks by turning its front end downward and simultaneously, actuating the support members $1_1$ of the collecting and moving means 1 for projecting motion to each other in the passage, and also, to produce another signal for proceeding of loading.

Additionally, there is above the support member $1_1$ in the loading position, another photo switch 10 mounted, in the same way a of the photo switch 5 but at a position above the same, for producing a signal (more particularly for actuating the picking robot 31 for infeeding with a bale of sheet-like container blanks C1) for preparation of the supply of sheet-like blanks C1 onto the support members upon detecting that the number of the sheet-like blanks C on the two confronting setting members $2_1$, $2_1$ decreases to less than a predetermined number (i.e. when the height of the blanks C is less than a determined height).

Beneath the center opening in the base plate 15, at the downward end of the sheet-like container blanks passage, there are mounted a transferring conveyor 25, also spaced a distance from the base plate 15, for transfer to the following step of procedure and a pulling infeed means 4, arranged with its suction boxes $4_2$ interposing between three conveyor belts $25_1$ respectively, for transferring one sheet-like packaging container blank from between the two confronting setting members $2_1$, $2_1$ in the bottom of the magazine I onto the conveyor 25. The conveyor 25 is arranged in which the conveyor belts $25_1$ of timing belt is mounted movably along properly spaced blank support rails 29 and turn about a guide pulley 28 to shift its running direction from backward to forward, so that the sheet-like blank C supplied by suction sections $4_1$ on the suction boxes $4_1$ can be transferred through the blank support rails 29 to the following step of procedure as being pressed with a transfer rib $25_2$ on the belt. Each of the suction boxes $4_2$ located between the blank support rails 29 has a pair of suction sections $4_1$, $4_1$ thereon for vacuum suction as being connected to pipings not shown and is mounted on a vertically movable plate 30 which can travel upward and downward with its guide rollers 26 moving along a fixedly mounted guide plate 33 as a rocking arm 35 mounted by a connecting rod 34 to the movable plate 30 performs rocking motion due to the rotation of a rotary cam 24. Accordingly, one of the sheet-like container blanks C is sucked with the suction sections $4_1$ when moving upward and when moving downward, withdrawn and transferred onto the conveyor belts $25_1$.

The operation of storing sheet-like packaging container blanks C in the magazine and transferring them one by one to the following step of procedure, will be described.

Figure 6:
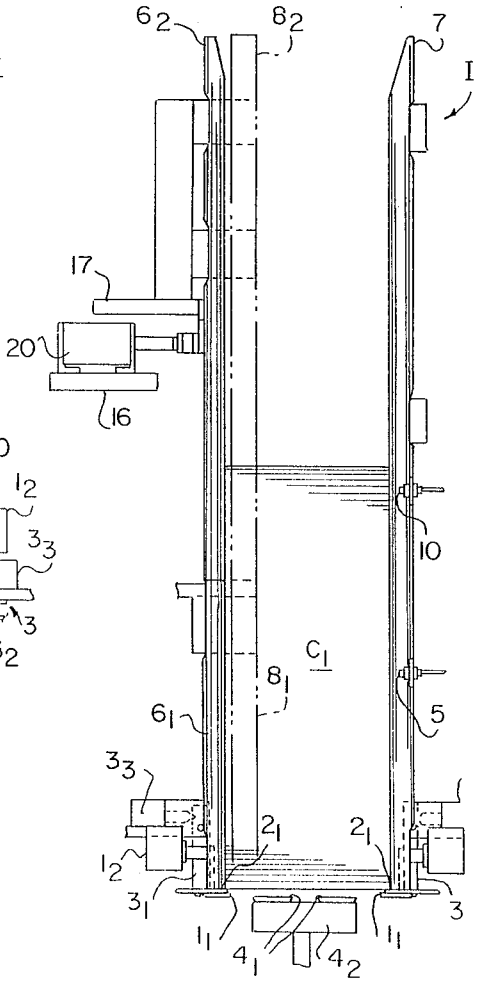
FIG. 6 is a front view of the primary section showing support members kept in projecting position after the pile of container blanks are moved downward to setting members.
Figure 5:
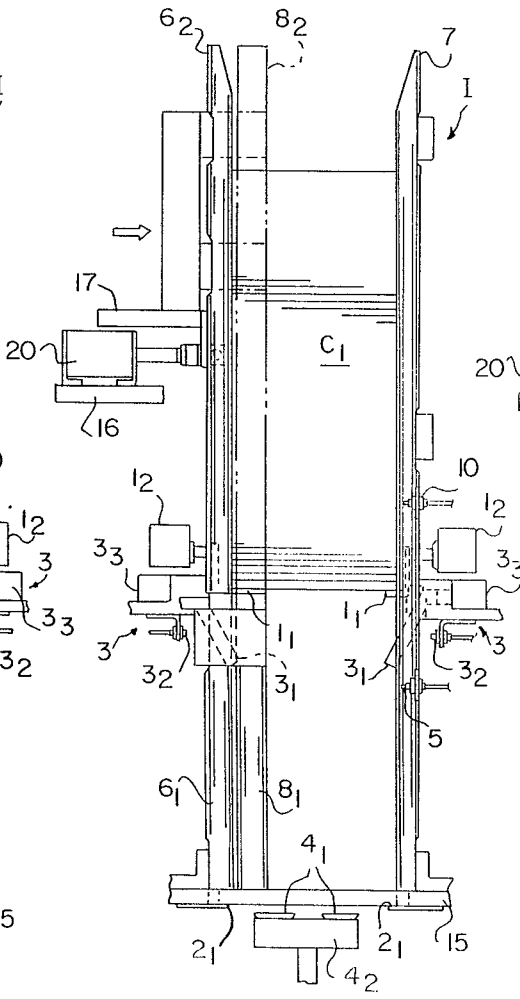
FIG. 5 is a front view showing the end of the loading of FIG. 4.
Figure 4:
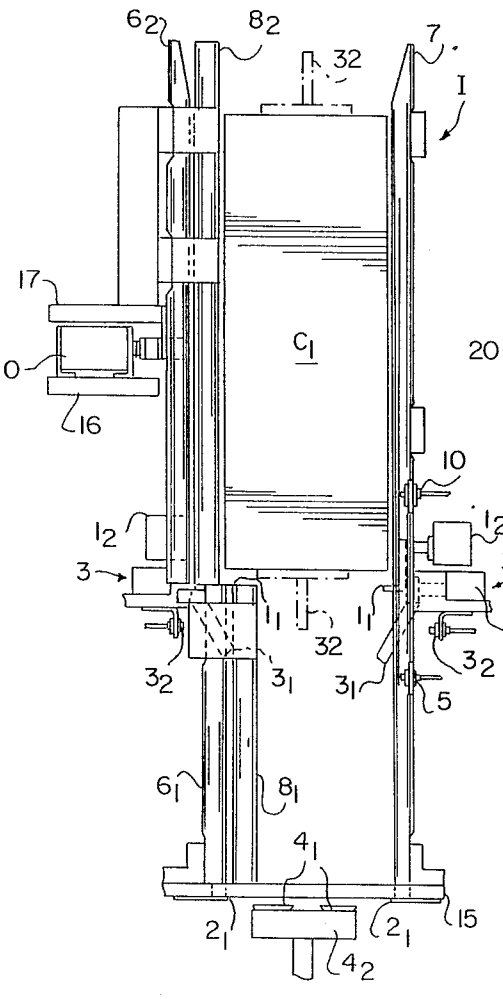
FIG. 4 is a front view of the primary section showing the loading of a bale of sheet-like packaging container blanks.
Figure 7:
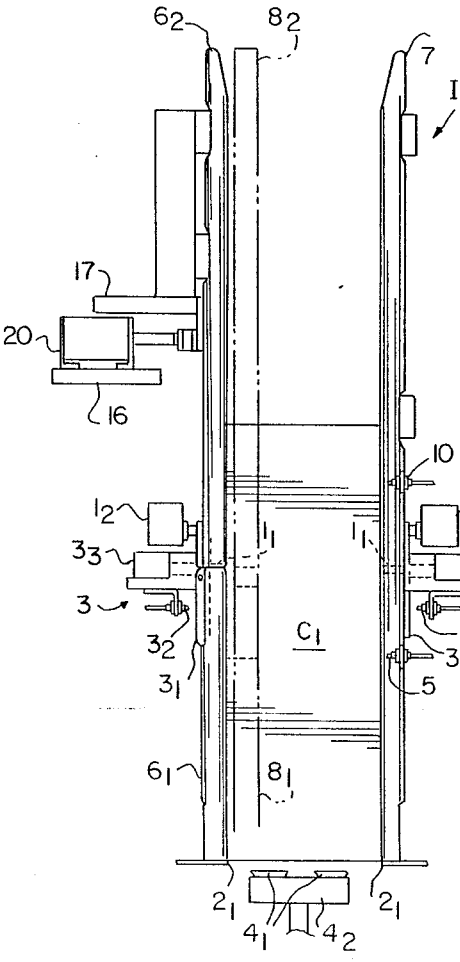
FIG. 7 is a front view of the primary section showing the support members and press-down claws lifted upward with the piled container blanks seating on the setting members.

A bale of sheet-like packaging (e.g. 1000 cc capacity) container blanks C1 is first transferred from the multiple pre-supply magazines, not shown, disposed in parallel arrangement to the front of the magazine I in the apparatus by the picking robot 31 which travels with its paired folks 32, 32 grabing the bale C1 along a guide rails not shown. As the picking robot 31 operates with its head 31*a* coming to over the magazine 1, the bale of a specified number (e.g. 250) of sheet-like packaging container blanks C1 grabed by the upper and lower folks 32, 32 is loaded into the magazine I, which contains no blanks with its photo switches 10 and 5 kept in non-detecting state, by inserting it between the upper left guide bars $6_2$, $8_2$ in their respective retracting positions and the right guide bars 7 (see FIG. 4). Then, this action is detected by the upper photo switch 10 and thus, the auto-siwtch equipped cylinder 20 on the upper shelf plate 16 starts operating. The guide bars $6_2$, $8_2$ which are integrally mounted in mutually positional relationship on the opening/closing guide bar support 17 mounted fixedly to the piston of the cyliner 20, move to the right so as to be positioned coaxially of the left guide bar $6_1$ on the base plate 15 and of the guide bar $8_1$ at the nearside, or loarding side on the base plate 15 respectively. As a result, the moving passage of piled blanks C1 is formed to extend in a vertical direction. As those guide bars are arranged tilting, the pile of blanks is restricted between the left and right guide bars 6, 7 by the guide bars 8 in the loading side during loading onto the paired support members $1_1$, $1_1$ (see FIG. 5). As the collecting and moving means 1 containing the sheet-like blanks pile C1 placed on the confronting support members $1_1$, $1_1$ moves downward, the press-down claws $3_1$ of the pressing-down means 3 are pressed on the back by the inner sides of the C-shaped portions of their respective support members $1_1$, $1_1$ and retract from the passage of container blanks. Then, it moves further until the support members $1_1$, $1_1$ come to just below the the left and right guide bars $6_1$, 7 mounted fixedly on the base plate 15, so that the pile of sheet-like container blanks C1 can sit on the two setting members $2_1$, $2_1$ mounted to the lowermost ends of the guide bars $6_1$, 7 for facing each other and extending inwardly to an extent (see FIG. 6). The support members $1_1$, $1_1$ *of the collecting and moving means* 1 *move backward as leaving the pile of sheet-like blanks* C1 *on the setting members* $2_1$, $2_1$ and the collecting and moving means 1 return to the original loading position with the support members $1_1$ retracted and the press-down claws $3_1$ kept withdrawn from the passage of container blanks (see FIG. 7). As the packaging machine runs for performing filling operations, the piled sheet-like packaging container blanks C are removed one by one from the setting members $2_1$ at the lowermost ends of the guide bars $6_1$, 7 by the suction of the suction sections $4_1$ during the vertical motion of the suction boxes $4_2$ and placed on the conveyor 25. The container blanks C are then transferred to a blank build-up device in the next step of procedure.

Figure 9:
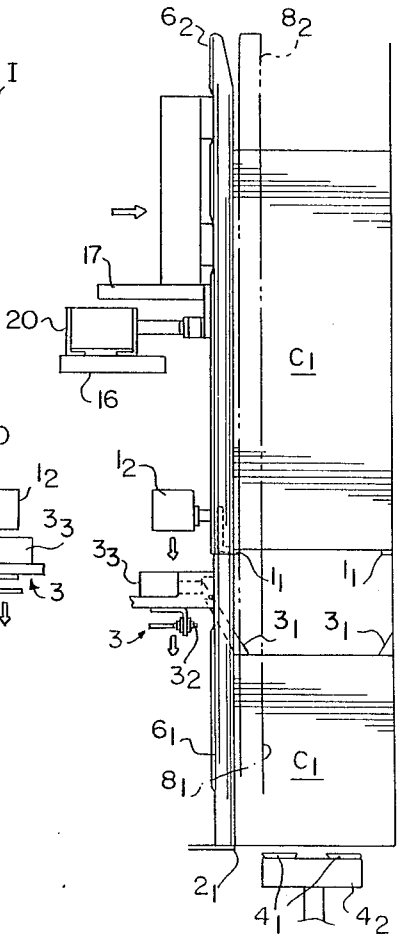
FIG. 9 is a front view of the primary section showing the existing container blanks in the lower pressed downward by the press-down claws while another bale of container blanks being supplied.
Figure 8:
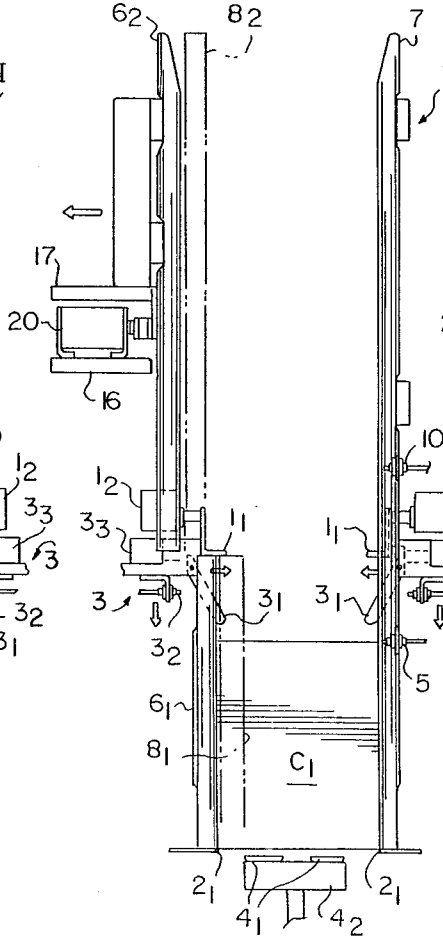
FIG. 8 is a front view of the primary section showing the upper face of the blanks pile lowered and detected by a lower photo switch.
Figures 10, 11, 12:
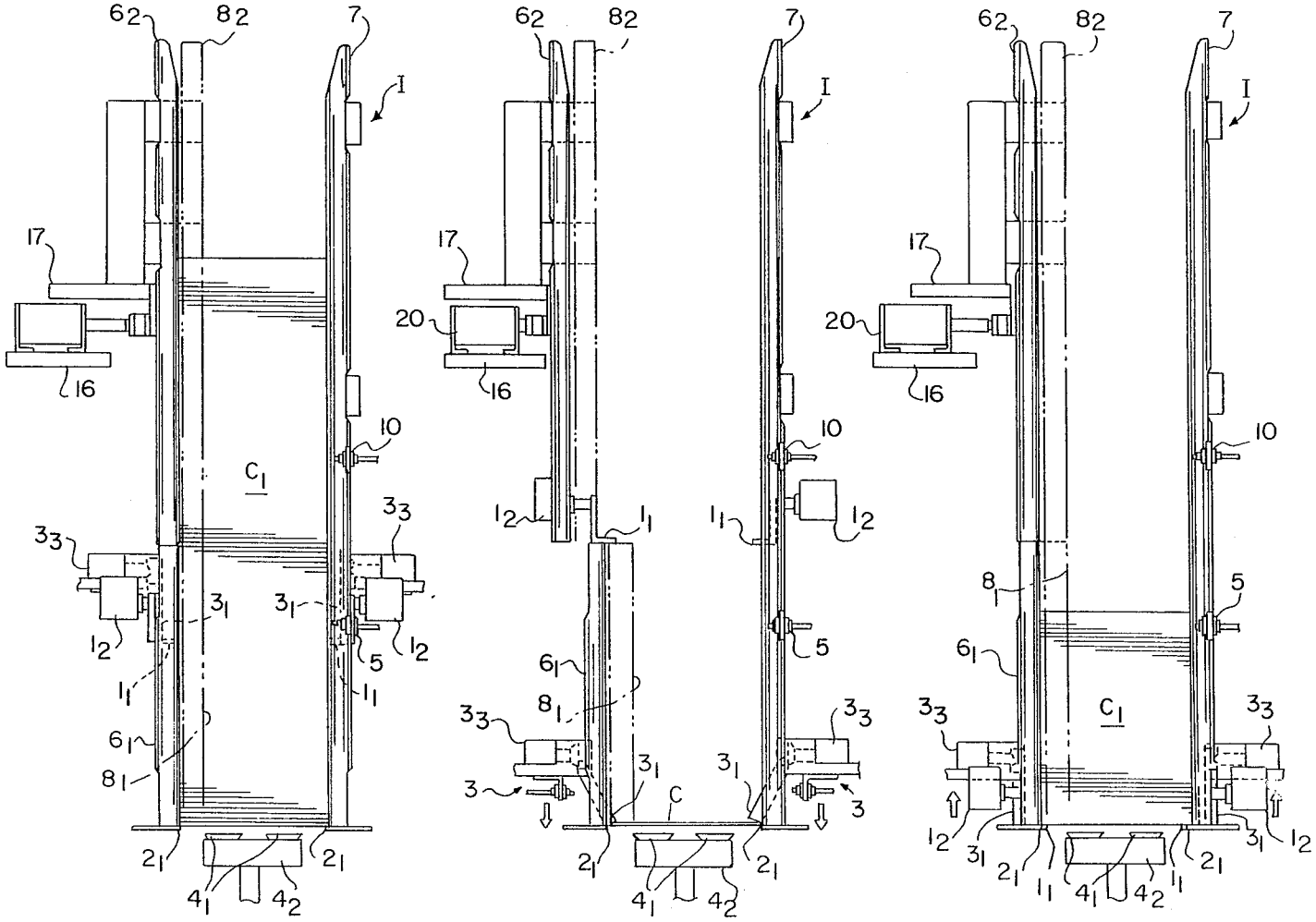
FIG. 10 is a front view of the primary section showing the container blanks in the upper joined to the existing container blanks in the lower.
FIG. 11 is a front view of the primary section showing the last one of sheet-like container blanks being pulled outward.
FIG. 12 is a front view of the primary section showing the remaining pile of container blanks on the setting members being lifted upward by the support members.

As the operation proceeds, the height of the sheet-like packaging container blanks C1 decreases gradually. When the uppermost face of the pile of container blanks C1 reaches the detecting position of the lower photo switch 5 situated beneath the position of the upper photo switch 10, the photo switch 5 activates the press-down claws $3_1$ for releasing from the retraction. The press-down claws $3_1$ is thus moved downward as projecting inwardly. On the other hand, the cylinder $1_2$ is actuated to move the support members $1_1$ of the collecting and moving means 1 into the passage of container blanks and simultaneously, the support members $1_1$ are lifted downward. When the auto-switch equipped cylinder 20 on the upper shelf plate 16 is actuated, the guide bars $6_2$, $8_2$ in the upper left retract from the loading passage of sheet-like blanks for the following loading (see FIG. 8). When the upper photo switch !0 produces a signal upon detecting the passing of the uppermost end of the sheet-like blanks pile C1 thereacross, the picking robot 31 starts moving to fetch another bale of blanks C1 in the pre-supply magazine and brings it back to the front of the magazine I of the apparatus for loading. The bale of blanks C1 loaded onto the support members $1_1$, $1_1$ moves downward while the pile of blanks on the setting members $2_1$, $2_1$, situated beneath, descreases in number with its top end being pressed downward by the inwardly projecting press-down claws $3_1$, $3_1$ (see FIG. 9). The supplied sheet-like blanks C1 in the upper are lowered further upto the existing container blanks C1 in the lower when having actuated the press-down claws $3_1$, $3_1$ for retraction. At the time, the cylinder $1_2$ of the collecting and moving means 1 is thus actuated and the support members $1_1$, $1_1$ retract from the blanks passage. As the result, the supplied container blanks can be piled up on the pile of existing container blanks in the lower (see FIG. 10). As the operation proceeds, the uppermost end of the container blanks pile lowers. When the photo switch 10 mounted in a position detects the decrease of existing container blanks C1, the picking robot 31 starts again to carry a further bale of sheet-like packaging container blanks C1 from the pre-supply magazine. Then, the supply of container blanks is carried out when the photo switch 5 detects the decrease of the existing container blanks. As this procedure is repeated, the sheet-like container blanks C1 are transferred one by one to the blank build-up device of the next step of procedure continuously and automatically.

When a signal of operation stop is supplied, the picking robot 31 stops the supply of container blanks bale C1 to the magazine I. The piled container blanks on the setting members $2_1$, $2_1$ are removed up until the magazine I is exhausted, as with the upper face being pressed against the setting members $2_1$ by the press-down claws $3_1$ of the pressing-down means 3. Thus, all the container blanks remaining in the magazine I can be transferred (see FIG. 11).

If the operation on the packaging machine is altered due to a change in the capacity of a container (e.g. from 1000 cc to 500 cc), required container blanks can readily be supplied at any time of the operation in the manner described below. When the supply of the present container blanks to the magazine I with the picking robot 31 has been stopped, the suppoer members $1_1$, $1_1$ of the collecting and moving means 1 are actuated for retraction from the blanks passage and moved downward upto the lowest position just below the setting members $2_1$, $2_1$. Then, the support members $1_1$, $1_1$ are actuated for supporting of the remaining blanks $C_1$ (see FIG. 12) and lifted upward to the original loading position with the blanks C1 held thereon (see FIG. 5). The guide bars $6_2$, $8_2$ in the upper left are moved leftward and particularly, the guide bars $8_2$ are retracted from the blanks passage. This allows the picking robot 31 in the front of the magazine I to grab the remaining container blanks with its folks 32, 32, and withdraw from the magazine I to carry back to the pre-supply magazine for restorage. Then, a bale of desired packaging container blanks C1 is selected and transferred to the front of the magazine I by the picking robot 31 for loading in the altered operation.

Although the embodiment according to the present invention is described in reference to the supply of sheet-like packaging container blanks, it is not limited to the container blanks. It is understood that various modifications may be made for the supply of sheet-like materials of other type in specific applications without departing from the scope of the present invention.

As it is apparent from the description set forth above, the effect of the present invention is:

According to the apparatus defined in Claims of the present invention, for temporarily storing a pack of sheet-like materials in a magazine after supplied from a storage and transffering them to the next step of procedure during the required operation, the plurality of sheet-like materials are carried by transferring means such as a picking robot from the storage, loaded onto confronting support members projecting from the sides of confronting guide members which are arranged to guide the sheet-like materials in vertical directions, lifted downward, placed in position on setting members, and, upon being pulled outward one by one, transferred to the next step of procedure. Accordingly, when the sheet-like materials decrease in number as being consumed during operation, a supplementary bale of materials is automatically carried to a loading position for re-supply. As the sheet-like materials are continuously re-supplied by adding the supplementary bale of materials to the existing materials, a magazine in the apparatus is automatically, or without the need of labor work, filled with the sheet-like materials which are then transferred one by one to the next step of procedure. Thus, the working efficiency will be improved and the cost of labor can be reduced. Additionally, in the end of operation, the remaining materials can all be removed off, till the magazine I is exhausted, for transferring to the next step. Furthermore, the existing sheet-like materials in the magazine I can be lifted upward from the setting position to the original loading position and thus, returned back to the external storage with the use of transferring means such as a picking robot with great ease. This will also improve the working efficiency and allows the replacement of sheet-like materials can readily made when a change for the operation is needed.

According to the apparatus defined in Claims of the present invention, the apparatus itself is tilted to the loading side in which the guide members are also tilted and particularly, the tilting guide members in the loading side can be retracted with their respective loading portions from the passage of loading. Even if a device for the next step of procedure is tilted, the sheet-like materials can assuredly be loaded into the magazine and then, transferred from the magazine to the device in the next step smoothly.

According to the apparatus defined in Claim of the present invention, the support members by which the sheet-like materials are supported actuate the press-down claws for retraction from the vertically extending passage of materials blanks during the downward movement. More particularly, the support member can keep the press-down claw in the retracting position with the use of the opening of its C-shaped portion and also, by actuating a claw stopper with the use of proximity detecting means.

According to the apparatus defined in Claims of the present invention, the detecting means mounted above the loading position of the support members produces a preparation signal for loading of sheet-like materials onto the apparatus when the existing sheet-like materials decreases in number during operation. Then, the signal actuates means for transferring sheet-like materials such as a picking robot for constant loading of the materials into the magazine, whereby continuous operations can be carried out without interruption.

According to the apparatus defined in Claims of the present invention, the sheet-like materials can smoothly be transferred from the support members to the setting members and then, pulled outward one by one from the setting members continuously.

I claim:

1. An apparatus for storing and supplying sheet-like materials in which a multiplicity of uniform sheet-like materials supplied are temporarily stored in a pile and then, removed one by one for transferring to the next step of procedure, characterized by: at least confronting guide members 6 and 7 for guiding the sheet-like materials in vertical directions; collecting and moving means 1 for transferring sheet-like materials, arranged movable vertically with confronting support members $1_1$, $1_1$ projectable inwardly from the side of said guide members 6 and 7 from an upper loading position where the plurality of sheet-like materials C1 can be loaded onto the support members $1_1$, $1_1$ for downward transfer to a lower position where the support members $1_1$, $1_1$ can retract to release the supporting of the sheet-like materials C1 for further downward transfer; pile setting means 2 provided beneath said collecting and moving means 1 and arranged for receiving the sheet-like materials C1 released from said collecting and moving means 1 with a pair of confronting setting members $2_1$, $2_1$, or the sheet-like materials C1 being placed onto the existing pile of sheet-like materials C1 which are previously transferred from said collecting and moving means 1 to the setting members $2_1$, $2_1$, and for removing the sheet-like materials C1 from the bottom thereof; pressing-down means 3 for pressing the sheet-like materials C1 downward with its own weight, provided beneath said collecting and moving means 1 and above the setting members $2_1$, $2_1$ for downward movement cooperatively with said collecting and moving means 1 and pressing at least one sheet-like material C to the setting surfaces of the setting members $2_1$, $2_1$ of said setting means 2, and having a pair of confronting press-down claws $3_1$, $3_1$ projectable to a downward transfer passage of sheet-like materials when a detecting means 5 generates a signal upon detecting that the number of the sheet-like materials C1 on the setting members $2_1$, $2_1$ decreases to less than a predetermined setting while retracting as being pressed by the support members $1_1$, $1_1$ during the downward movement of said collecting and moving means 1; and pulling infeed means 4 mounted beneath said setting means 2 and having vertically movable suction sections $4_1$ for pulling the sheet-like materials C1 one by one outward from said setting means for transferring to the next step of procedure, so that the sheet-like materials C1 loaded into said collecting and moving means 1 can continuously be transferred downward to said setting means 2 by transferring the sheet-like materials C1, which are loaded onto the support members $1_1$, $1_1$ of said collecting and moving means 1 actuated for projection by a loading signal, from said collecting and moving means 1 to the upper surface of the pile of existing sheet-like materials C1 placed on the confronting setting members $2_1$, $2_1$ which are pressed downward by the confronting press-down claws $3_1$, $3_1$ of said pressing-down means 3 actuated for projection by a signal derived from the detecting means 5 when the uppermost surface of the existing sheet-like materials C1 passes a predetermined point in the upper of said setting means 2, and removed one by one by the pulling of said pulling infeed means 4 for transfer to the next step of procedure, while the remaining sheet-like materials in said setting means 2 can be returned by lifting upward back to the loading position for removal.

2. An apparatus for storing and supplying sheet-like materials as defined in claim 1 wherein said collecting and moving means 1, pile setting means 2, and pressing-down means 3 are mounted vertically and arranged tilting in a degree to the loading side of the pile of sheet-like materials C1 and also, incorporated with guide members 6, 7, and 8 arranged tilting to the loading side for guiding the pile of sheet-like materials C1 movable in vertical directions at least in the left and right sides and loading side of its lengthwise direction, said guide members 7 being arranged in a line at one side, said guide members 6 facing said guide members 7 and being separated into upper and lower portions, said guide members 8 for restriction in the loading side being separated into upper and lower portions, the lower portions $6_1$, $8_1$ of said guide members 6, 8 separated at a position jut below the loading position of the vertically movable support members $1_1$, $1_1$ of said collecting and moving means 1 being arranged in fixed relationship to said guide members 7 while the upper portions $6_2$, $8_2$ of the same being integrally arranged for movement away from said guide members 7 with said guide member $8_2$ retracting from the passage of sheet-like materials due to a signal from said detecting means 5.

3. An apparatus for storing and supplying sheet-like materials as defined in claim 1 or 2 wherein said press-down claw $3_1$, which is pivotably mounted and urged inwardly, when retracting as being pressed by the support member $1_1$ during the downward movement, is pressed in the upper back outwardly by the inner side $1_1$, of a C-shaped portion of the support member $1_1$ projecting into the vertically opening passage of sheet-like materials and thus, kept withdrawn from the passage by a claw stopper $3_4'$ actuated by a signal derived from proximity detecting means $3_2$ provided in a position in the back of said press-down claw $3_1$.

4. An apparatus for storing and supplying sheet-like materials as defined in claim 1 or 2 wherein detecting means is provided above the loading position of the support members $1_1$ of said collecting and moving means 1 for sending a preparation signal for loading of the sheet-like materials C1 on the support members $1_1$, $1_1$ of said collecting and moving means 1 onto the uppermost surface of the existing sheet-like materials C1 on the setting members $2_1$, $2_1$ of said pile setting means 2 upon detecting that the number of the existing sheet-like materials C1 on the setting members $2_1$, $2_1$ decreases to less than a predetermined number.

5. An apparatus for storing and supplying sheet-like materials as defined in claim 2 wherein said confronting setting members $2_1$, $2_1$ of said pile setting means 2 are mounted to the lowermost ends of the guide members $6_1$ and 7, which guide the sheet-like materials in vertical directions, so as to extend inwardly to an extent while each of said support members $1_1$ is arranged between said lengthwisely spaced setting members $2_1$, $2_1$ for vertical movement.

6. An apparatus for storIng and supplying sheet-like materials as defined in claim 3 wherein detecting means 10 is provided above the loading position of the support members $1_1$ of said collecting and moving means 1 for sending a preparation signal for loading of the sheet-like materials C1 on the support members $1_1$, $1_1$ of said collecting and moving means 1 onto the uppermost surface of the existing sheet-like materials C1 on the setting members $2_1$, $2_1$ of said pile setting means 2 upon detecting that the number of the existing sheet-like materials C1 on the setting members $2_1$, $2_1$ decreases to less than a predetermined number.

7. An apparatus for storing and supplying sheet-like materials as defined in claim 3 wherein said confronting setting members $2_1$, $2_1$ of said pile setting means 2 are mounted to the lowermost ends of the guide members $6_1$ and 7, which guide the sheet-like materials in vertical directions, so as to extend inwardly to an extent while each of said support members $1_1$ is arranged between said lengthwisely spaced setting members $2_1$, $2_1$ for vertical movement.

8. An apparatus for storing and supplying sheet-like materials as defined in claim 4 wherein said confronting setting members $2_1$, $2_1$ of said pile setting means 2 are mounted to the lowermost ends of the guide members $6_1$ and 7, which guide the sheet-like materials in vertical directions, so as to extend inwardly to an extent while each of said support members $1_1$ is arranged between said lengthwisely spaced setting members $2_1$, $2_1$ for vertical movement.

9. An apparatus for storing and supplying sheet-like materials as defined in claim 6 wherein said confronting setting members $2_1$, $2_1$ of said pile setting means 2 are mounted to the lowermost ends of the guide members $6_1$ and 7, which guide the sheet-like materials in vertical directions, so as to extend inwardly to an extent while each of said support members $1_1$ is arranged between said lengthwisely spaced setting members $2_1$, $2_1$ for vertical movement.

10. An apparatus for storing and supplying sheet-like materials wherein a plurality of sheet-like materials supplied thereto are temporarily stored in a pile and then removed one by one to a next step of procedure comprising:

a guide member comprising a plurality of guide bars, said guide member guiding said sheet-like materials in vertical direction;

a collecting and moving means for transferring said sheet-like materials, said collecting and moving means having support members projectable into said guide member and being movable vertically from an upper loading position where a plurality of sheet-like materials can be loaded onto said support members to a lower position where said support members retract and release said sheet-like materials;

a pile setting means provided beneath said collecting and moving means, said pile setting means receiving said sheet-like materials released from said collecting and moving means with a pair of setting members or with sheet-like materials which have been transferred from said collecting and moving means to said setting members, so that said sheet-like materials are removed from the bottom of said pile setting means;

a pressing-down means for pressing down said sheet-like materials with its own weight, said pressing-down means being provided beneath said collecting and moving means and above said setting members so as to move downward cooperative with said collecting and moving means, said pressing-down means being designed so that it pressing at least one sheet-like material to setting surfaces of said setting members and having a pair of confronting press-down-claws which are projectable into a downward transfer passage for said sheet-like materials when a detecting means generates a signal upon detecting that said sheet-like materials on said pile setting members decreases less than a predetermined amount, said press-down-claws being kept retracted when pressed by said support members of said collecting and moving means which is downwardly moving; and a pulling and feeding means provided beneath said pile setting means and having vertically movable suction sections which pull said sheet-like materials one by one out of said pile setting means.

* * * * *